US010704761B1

(12) United States Patent
Zhu

(10) Patent No.: US 10,704,761 B1
(45) Date of Patent: Jul. 7, 2020

(54) INFLATABLE DECORATIVE SYSTEM

(71) Applicant: Ganzhou SHANGJIE Technologies Co. Ltd., Ganzhou (CN)

(72) Inventor: Jianjun Zhu, Huizhou (CN)

(73) Assignee: GANZHOU SHANGJIE TECHNOLOGIES CO., LTD., Ganzhou (CN)

( * ) Notice: Subject to any disclaimer, the term of this patent is extended or adjusted under 35 U.S.C. 154(b) by 0 days.

(21) Appl. No.: 16/442,427

(22) Filed: Jun. 14, 2019

(30) Foreign Application Priority Data

May 17, 2019 (CN) ..... 2019 1 0412806

(51) Int. Cl.
*F21V 3/00* (2015.01)
*F21V 3/02* (2006.01)
*F21V 19/00* (2006.01)

(52) U.S. Cl.
CPC ..... *F21V 3/026* (2013.01); *F21V 19/00* (2013.01); *F21V 3/023* (2013.01); *Y10S 362/806* (2013.01)

(58) Field of Classification Search
CPC . F21V 3/026; F21V 3/02; F21V 3/023; F21V 19/00; F21V 1/06; F21V 3/00; F21V 17/00; Y10S 362/806; Y10S 362/809; A63H 33/003; A63H 27/10
See application file for complete search history.

(56) References Cited

U.S. PATENT DOCUMENTS 4,179,832 A 12/1979 Lemelson
5,795,211 A 8/1998 Carignan et al.
6,626,559 B1 * 9/2003 Lin ..... F21V 3/023 362/123
6,786,793 B1 9/2004 Wang
8,356,926 B1 1/2013 Sanders
8,469,538 B2 6/2013 Leung
8,550,663 B2 10/2013 Tone
2005/0146862 A1 * 7/2005 Liu ..... F21V 3/023 362/101

(Continued)

FOREIGN PATENT DOCUMENTS

CN 106224803 A 12/2016
CN 206055552 A 3/2017
CN 206055552 U 3/2017

OTHER PUBLICATIONS

European Patent Office, European Search Report, App. No. 19184120.4-1126 dated Oct. 30, 2019.

*Primary Examiner* — Y M. Quach Lee
(74) *Attorney, Agent, or Firm* — Hemisphere Law, PLLC; Zhigang Ma

(57) ABSTRACT

An inflatable decorative system includes an inflatable hollow bag body provided with an inflation port and a line hole, a plurality of first fixing portions having perforations or hook portions and arranged on an inner wall of the bag body, and a light string system. At least an end portion extends out of the bag body from the line hole, and the remaining portions are arranged inside the bag body and fixed among the plurality of first fixing portions so that the light string system is unfolded into a preset shape in the bag body after the bag body is inflated. The light string system can be directly hung among the plurality of fixing portions, and can also be fixed among the plurality of fixing portions by a reinforcing strip or reinforcing line.

9 Claims, 3 Drawing Sheets

(56) References Cited

U.S. PATENT DOCUMENTS

| | | | | |
|---|---|---|---|---|
| 2006/0198138 | A1* | 9/2006 | Seika | A47G 33/06<br>362/234 |
| 2007/0141947 | A1 | 6/2007 | Chin-Cheng | |
| 2008/0084689 | A1 | 4/2008 | Fletcher | |
| 2008/0170384 | A1* | 7/2008 | Zhu | F21V 1/14<br>362/122 |

* cited by examiner

INFLATABLE DECORATIVE SYSTEM

CROSS-REFERENCE TO RELATED APPLICATION

This application claims priority benefit of Chinese Application 201910412806.4, filed on May 17, 2019, said application being fully incorporated by reference herein.

BACKGROUND OF THE INVENTION

1. Technical Field

The present invention relates to decorative systems for decoration, and particularly relates to an inflatable decorative system carrying a light string system.

2. Description of Related Art

Decorative light strings are widely applied to various scenes. An existing inflatable balloon having a light string hung on an outer surface of the balloon is very popular to children, but the light string is hung outside so the light string is easily pulled or easily falls from the balloon, thereby resulting in poor shape or destruction. Inflatable decorative systems having the light string arranged in an inflation chamber also exist. For example, the Chinese utility model, having an application No. 201620605243.2 and filed on Jun. 20, 2016, discloses an inflatable lantern. The light string is fixed on one light hanging strip in the inflatable lantern; and then, a spiral light mounting bracket is hung on the light hanging strip so that the light string is fixed inside the inflatable lantern and not susceptible to the outside. However, the light string fixed in this way is easy to wobble inside the lantern, and is unstable and single in shape.

BRIEF DESCRIPTION OF THE SEVERAL VIEWS OF THE DRAWINGS

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

First Embodiment

Figure 1:
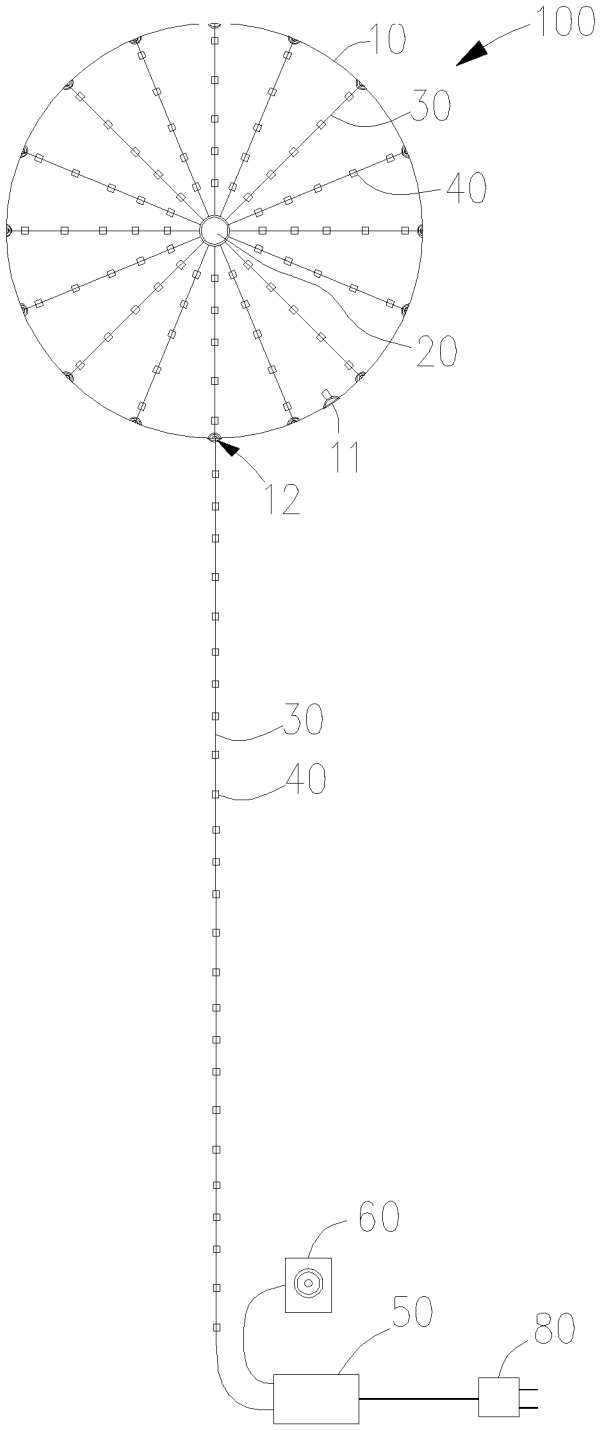
FIG. 1 is a structural schematic diagram of an inflatable decorative system according to a first embodiment.
Figure 2:
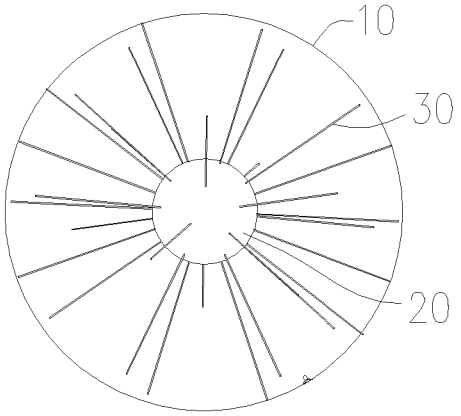
FIG. 2 is a perspective view of a bag body, an intermediate fixing portion and number of reinforcing strips of the inflatable decorative system according to the first embodiment.
Figure 3:
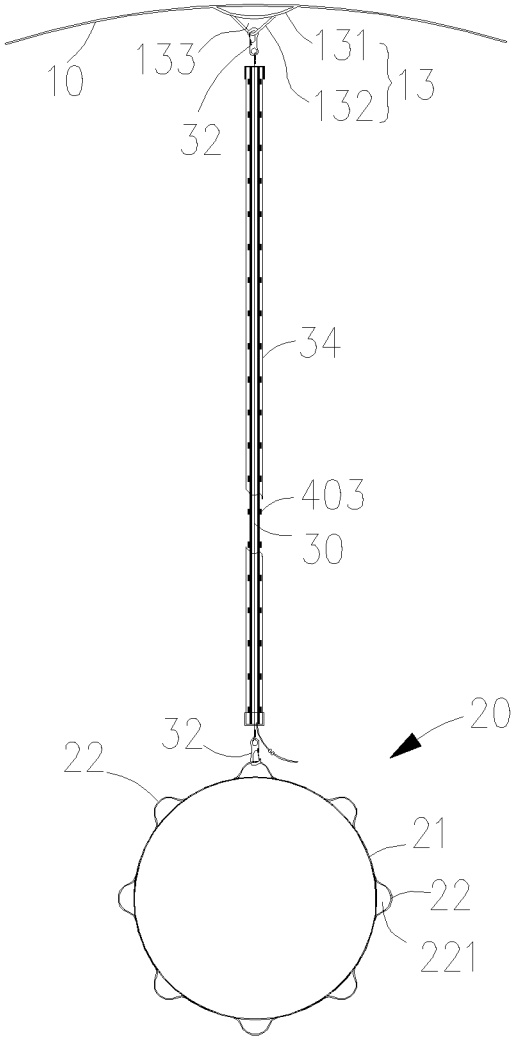
FIG. 3 is an enlarged view of a partial structure of an inflatable decorative system in FIG. 1.

Please refer to FIGS. 1-3, an inflatable decorative system 100 in accordance with the first embodiment of the present invention mainly includes an inflatable hollow bag body 10, an intermediate fixing portion 20, a plurality of reinforcing strips 30 connected between the bag body 10 and the intermediate fixing portion 20, a light string system 40, a controller 50 connected with the light string system 40, and a loudspeaker 60 connected with the controller 50. The controller 50 and the loudspeaker 60 are located outside the bag body 10.

For the convenience of observation, FIG. 1 shows a schematic diagram after the hollow bag body 10 is cut away a front part and a rear part, only the middle part is remained, only shows the strip 30 and the light string system 40 located on a cross section of the middle part of the light string system 40. That is, the strips 30 and the light string system 40 located on the front part and the rear part of the bag body are omitted. FIG. 2 is a schematic stereogram only illustrating the bag body 10, the intermediate fixing portion 20 and the strips 30, in which the bag body 10 is in an inflated state. FIG. 3 is a structural diagram showing a part of the bag body 10, the intermediate fixing portion 20, and one strip 30 connected between the part of the bag body 10 and the intermediate fixing portion 20.

The bag body 10 is made of a transparent plastic material, for example, PVC (polyvinyl chloride), and is provided with an inflation port 11 and a line hole 12. The inflation port 11 is a conventional inflation port with a sealing cap and is the same as or similar to the inflation port generally configured on a swim ring. The line hole 12 is used for a power line of the light string system 40 to pass through. A gap between the power line and the line hole 12 is sealed by a gastight material such as a silicone material and a resin material, so that only the inflation port 11 serves as an inflation and deflation port. The bag body 10 is a single-layer bag body and is generally spherical after being inflated. A plurality of mutually independent first fixing portions 13 are substantially uniformly fixed on an inner wall (inner surface) of the bag body, i.e., the plurality of first fixing portions 13 are preferably uniformly distributed at 360 degrees roughly relative to a center of the inflated bag body. It can be understood that the line hole 12 and the material for sealing the line hole 12 should serve as the first fixing portions 13.

Figure 4:
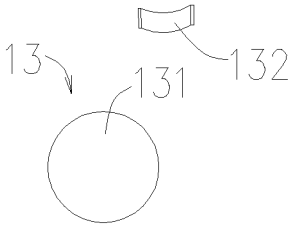
FIG. 4 is a structural schematic diagram of a first fixing portion of the inflatable decorative system in FIG. 1.

Please refer to FIG. 4 at the same time, in the present embodiment, each first fixing portion 13 includes a circular base body 131, one surface of which is fixed on an inner surface of the bag body 10, and the other surface of which is fixed with a strip 132. Both ends of the strip 132 are connected with the base body 131 so that a perforation 133 is formed between the strip 132 and the base body 131. Materials of the base body 131 and the strip 132 are preferably the same as the material of the bag body 10. The base body 131 is fixedly connected with the inner wall of the bag body 10 by hot pressing, and may be integrally fixedly connected with the inner wall of the bag body 10; or, only the periphery may be fixedly connected with the inner wall of the bag body.

The intermediate fixing portion 20 includes a hollow sphere 21 and a plurality of second fixing portions 22 arranged on the sphere 21. The second fixing portions 22 are protrusion portions protruding from the surface of the sphere 21; and perforations 221 are formed in the second fixing portions. The intermediate fixing portion 20 may be integrally molded by thermosetting plastics, or may also be made of metal or plastic materials. Preferably, the plurality of second fixing portions 22 on the intermediate fixing portion 20 are uniformly distributed at 360 degrees from the center of the sphere 21.

Figure 7:
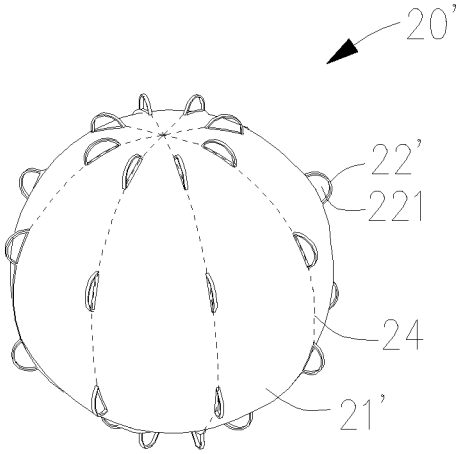
FIG. 7 is a structural schematic diagram of a variation embodiment of an intermediate fixing portion of the inflatable decorative system according to the first embodiment.

Alternatively, the second fixing portions 22 may also be arranged according to a certain rule, instead of being uniformly distributed. For example, the plurality of second fixing portions 22' of the intermediate fixing portion 20' as shown in FIG. 7 are distributed on a plurality of circles (circles shown by dotted lines 24 in FIG. 4) on the surface of a sphere 21'; the circles 24 are intersected at two opposite end points of the sphere 21; and the circles 24 and the second fixing portions 22' distributed thereon are rotationally symmetric relative to an axis penetrating the two end points.

A plurality of reinforcing strips 30 are respectively connected between the first fixing portion 13 on an inner surface of the bag body 10 and the second fixing portion 22 on the surface of the intermediate fixing portion 20, and are used for restricting the intermediate fixing portion 20 to a preset position within the bag body 10 after the bag body 10 is inflated and limiting a maximum size of the bag body. The strips 30 may be made of fibers, metal or alloy or soft plastics (for example, thermoplastics). In the first embodiment, two hook portions 32 are respectively fixed to both ends of each strip 30. The two hook portions 32 are respectively hooked on the first fixing portion 13 and the second fixing portion 22 to restrict the intermediate fixing portion 20 to the center of the bag body 10 (after the bag body is inflated).

Figure 5:
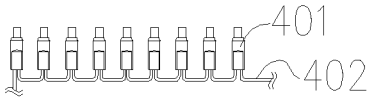
FIG. 5 is a structural schematic diagram of a light string in the traditional technical.
Figure 6:
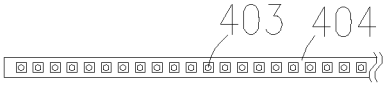
FIG. 6 is a structural schematic diagram of a light strip (LED strip light) in the traditional technical.

The light string system 40 may include one light string which includes plural of light bulbs 401 connected to a twisted pair wire 402 as shown in FIG. 5. Or the light string system 40 may include one or more light strips which include plural of LED chips 403 located on a long strip base 404 as shown in FIG. 6.

Figure 8:
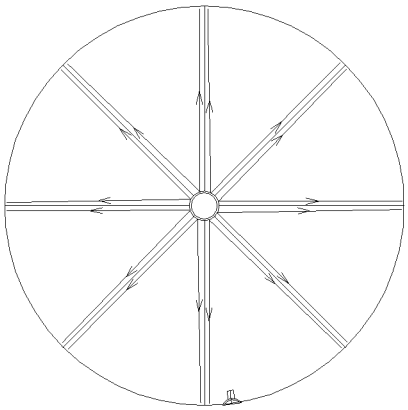
FIG. 8 is a schematic diagram showing an extending trend of a light string of the inflatable decorative system according to the first embodiment.

In the embodiment, the light string system 40 includes plural of light strips each includes plural of LED chips located on a long strip base. End(s) of the light string system 40 extend out of the bag body from the line hole 12 of the bag body 10, while the remaining portions are arranged inside the bag body and fixed among the plurality of first fixing portions 13 by the strips 30, so that the light string system 40 is unfolded into a preset shape in the bag body after the bag body 10 is inflated. As set forth above, in the present embodiment, the light string system 40 include a plurality of light strips connected by electrical wires. Each of the light strips includes a long strip-shaped flexible circuit board (base) and LED chips fixed on the flexible circuit board. The length of each flexible circuit board is shorter than that of the strip 30. The back of each flexible circuit board is pasted on the strip 30 to facilitate assembly. A form of gradually lighting up the light bulbs/LED chips from the center to the outside by configuring circuit connection between the light strips, as shown by arrows in FIG. 8. Environmentally friendly fireworks are realized.

Figure 9:
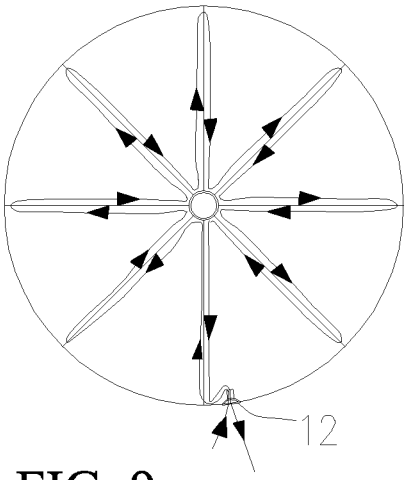
FIG. 9 is a schematic diagram showing an extending trend of a light string of an inflatable decorative system according to a variation embodiment of the first embodiment.

In another variation embodiment, a conventional Christmas tree light string, including the twisted pair wire and light holders holding light bulbs connected in series or in parallel to the twisted pair wire, may also be used. Please refer to FIG. 9, the light string is pasted on one surface of one strip 30 close to the line hole 12 after stretching in the line hole 12, extends to the intermediate fixing portion 20, then is pasted on one surface of another strip 30, is pasted on (folds back to) the other surface of the strip 30 after extending to a position close to the first fixing portion 13, extends to the intermediate fixing portion 20, sequentially extends along all the strips 30 in this way, finally returns to the line hole 12 along the first strip 30 and extends out of the line hole to integrally form a state of fireworks explosion (i.e., a state of radiating from the center to the periphery). An extending manner of the light string of the light string system 40 is as shown by arrowed lines in FIG. 9.

Figure 10:
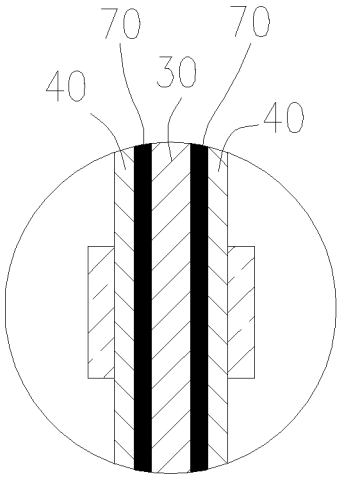
FIG. 10 is a schematic diagram of fixing of a reinforcing strip and a light string of the inflatable decorative system according to the first embodiment.

The light string system 40 and the strips 30 are fixed by glue 70 as shown in FIG. 10. For convenience of fixing and mounting, the light string system 40 and the strips 30 are pasted by a double-sided tape.

The light string system 40 may be existing various types of light strings and light strips, as long as it is convenient to be fixed and can realize a predetermined lightening mode. For example, the light string system 40 may include a three-line light string as disclosed in a China patent application No. 201810098261.X and filed on Jan. 31, 2018. In other embodiments, two or more light strings or light strips may be included, and are extended and fixed along a route shown in FIG. 8 or FIG. 9.

In the present embodiment, in order to protect the light string system 40, a transparent hose 34 is further sleeved on each strip 30. A portion of the light string/light strip fixed on the strip 30 is protected in the hose 34.

The ends of the light string system 40 and the reinforcing strip 30 extend out of the bag body 10 from the line hole 12. The light string system 40 is electrically connected with the external controller 50, and the reinforcing strip is mechanically connected with the external controller 50 to ensure safety of the power line. The controller 50 is configured to light up and extinguish the light string system 40, and is also configured to control an operating mode of the light string system when the light string system 40 has a plurality of operating modes. In the present embodiment, the controller 50 is further connected with a loudspeaker 60 for matching with work of the light string system 40 to output corresponding sound and create a specific effect. For example, when the light emitted from the light string system 40 is similar to a light effect of fireworks display, the controller controls the loudspeaker to correspondingly output the sound during fireworks display, thereby forming a unified visual and sound effect. For convenience of external power supply, the controller 50 may also be connected with a power connector 80 for realizing external power supply. At this time, a plurality of inflatable decorative systems may share one controller 50 and one loudspeaker; or a separate controller and loudspeaker may be provided for each of the inflatable decorative systems. It can be understood that a battery may be built in the controller to realize self-power supply.

It can be understood that the hose 34 may be omitted in other embodiments.

It can be understood that the loudspeaker 60 may be omitted in other embodiments.

It can be understood that the controller may be arranged at a position close to the line hole or fixed at the line hole in other embodiments.

Figure 11:
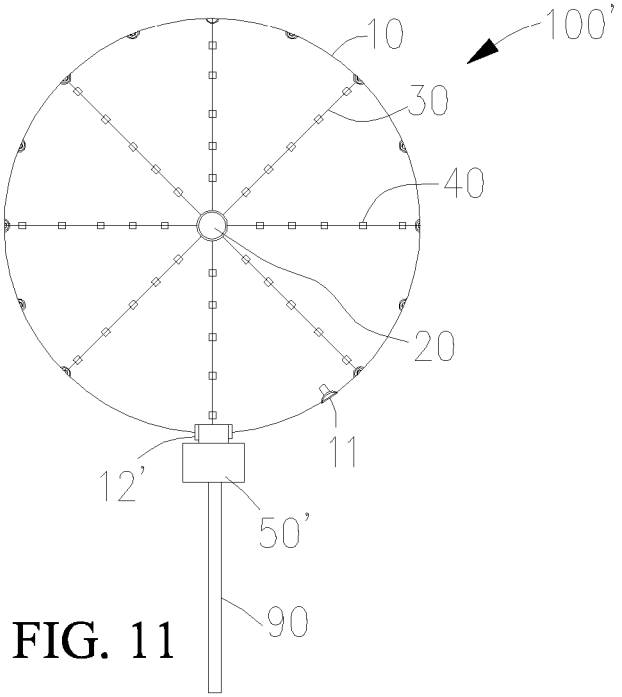
FIG. 11 is a structural schematic diagram of an inflatable decorative system according to a second embodiment.

For example, an inflatable decorative system 100' in a second embodiment shown in FIG. 11 is mainly different from the inflatable decorative system 100 in the first embodiment in that the controller 50' of the inflatable decorative system 100' is substantially columnar and includes a column capable of stretching into the inside of a line hole 12' of the bag body 10 and sealing the line hole 12'. The light string system 40 extends out from one end of the controller 50' stretching into the bag body 10. A conveniently held handle 90 is extended out from an end surface of the controller 50' located outside the bag body. The inflatable decorative system 100' in the present embodiment is further different from the inflatable decorative system 100 in the first embodiment in that the loudspeaker and the power connector are omitted, while the other portions may be the same.

Figure 12:
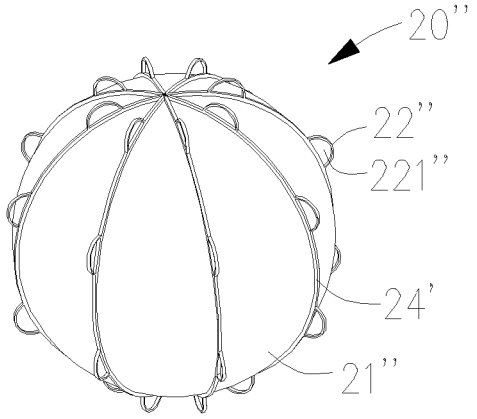
FIG. 12 is a structural schematic diagram of an intermediate fixing portion of an inflatable decorative system according to a third embodiment.

FIG. 12 shows that the difference between the inflatable decorative systems in a third embodiment and the first embodiment or 2 is mainly an intermediate fixing portion 20". In the present embodiment, the intermediate fixing portion 20" includes a hollow sphere 21" and a plurality of protrusion ribs 24' protruding from the surface of the sphere 21". The plurality of protrusion ribs 24' are respectively connected with two opposite ends of the sphere 21" to form a plurality of rings intersecting at two opposite end parts of the sphere 21. The intermediate fixing portion 20" further includes a plurality of second fixing portions 22" arranged on the protrusion ribs 24'. Perforations 221" are formed in the second fixing portions 22". The intermediate fixing portion 20" may be integrally molded by thermosetting plastics, and may also be made of metal or plastic materials. The protrusion ribs 24' and the second fixing portions 22" distributed thereon are rotationally symmetric relative to an axis of the two end points penetrating the sphere 21".

Figure 13:
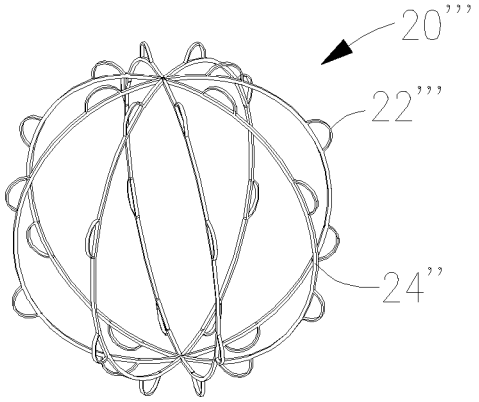
FIG. 13 is a structural schematic diagram of an intermediate fixing portion of an inflatable decorative system according to a fourth embodiment.

FIG. 13 shows a variation embodiment of the third embodiment: a fourth embodiment. The intermediate fixing portion 20'" in the fourth embodiment is different from the intermediate fixing portion 20" in the third embodiment in that the hollow sphere is omitted, and only protrusion ribs 24" and a plurality of second fixing portions 22'" located thereon are included.

It can be understood that the intermediate fixing portion may be a hollow sphere, and ribs between adjacent hollow portions can be used for connecting the hook portions (the hook portions 32 as shown in FIG. 2) at both ends of the reinforcing strips in other embodiments.

The intermediate fixing portions are all made of materials difficult to be deformed, and are stable in shape in the above embodiment. It can be understood that the intermediate fixing portion having a plurality of second fixing portions connectable to the hook portions 32 may be woven by soft fiber materials, and the woven intermediate fixing portion may be soft or hard. The intermediate fixing portion can be unfolded as long as the reinforcing strips are stretched after the bag body is inflated enough.

Figure 16:
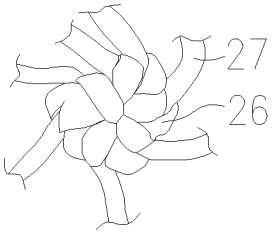
FIG. 16 is a structural schematic diagram of an intermediate fixing portion of an inflatable decorative system according to further another embodiment.

For example, as shown in FIG. 16, an intermediate fixing portion 26 is woven by soft fiber wires, several wires 27 extend out from the intermediate fixing portion 26 to act as reinforcing lines/ropes similar to the reinforcing strips 30 in the first embodiment. Free ends of the several wires 27 may be connected with hooks to connect with the first fixing portions. Under this condition, the second fixing portions are omitted.

The plurality of first fixing portions on the inner wall of the bag body are mutually independent in the above embodiments. The adjacent first fixing portions are connected to enhance tensile strength of the bag body in other embodiments.

Only one intermediate fixing portion is included and arranged in the middle of the bag body, while the first fixing portions are uniformly distributed on the inner wall of the bag body in the above embodiments. It can be understood that two or more intermediate fixing portions may be provided, and the reinforcing strips may be connected between the intermediate fixing portions for restricting positions of the intermediate fixing portions inside the bag body (after the bag body is inflated) in other embodiments. The first fixing portions may be laid out according to the shape which needs to be realized. In addition, the reinforcing strips may be simultaneously connected among the plurality of first fixing portions or between the reinforcing strips and the first fixing portions. The plurality of strips or lines are unfolded into a second preset shape, a third preset shape and the like, and the maximum size of the bag body may be limited after the bag body is filled with a gas. Rich shapes may be realized in this way.

Figure 14:
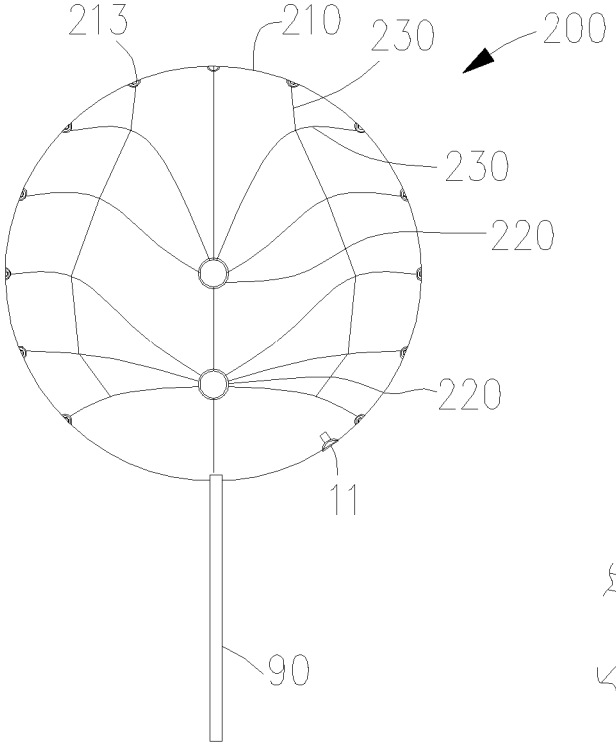
FIG. 14 is a structural schematic diagram of an inflatable decorative system according to a fifth embodiment.

For example, for the convenience of observation, FIG. 14 only shows the reinforcing strip and the intermediate fixing portion on the cross section after cutting the bag body (in an inflated state), does not show the reinforcing strips at other positions and also does not show the light string system in a fifth embodiment shown in the FIG. 14. The difference between the inflatable decorative system 200 shown in the fifth embodiment and that in the first embodiment mainly includes the number of the intermediate fixing portions and a connecting mode of the reinforcing strips. In the present embodiment, two intermediate fixing portions 220 are arranged in the bag body 210 of the inflatable decorative system 200. The reinforcing strips 230 are used for connecting the two intermediate fixing portions 220, connecting the intermediate fixing portions 220 with the first fixing portions 213 on the inner wall of the bag body 210, and further connecting upper and lower adjacent strips 230 in the FIG. 14 so that a part of the strips 230 are unfolded into a tree shape after the bag body is inflated, and the light string system is lighted up to show a tree-like overall shape by fixing the light string/light strip on a part of the reinforcing strips 230.

Figure 15:
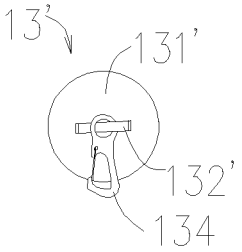
FIG. 15 is a structural schematic diagram of a first fixing portion according to another embodiment.

The first fixing portion is composed of a circular base body and strips in the above embodiments. In other embodiments, the base body may be omitted, and the strips are directly connected to the inner surface of the bag body to form the first fixing portions having the perforations. Alternatively, the base body may not be of a circular sheet shape, but may be of a square or elliptical sheet shape. The first fixing portions may also be suction cups which are in hot-melting connection with the inner surface of the bag body. Free ends of the suction cups are provided with the perforations or hook portions. Alternatively, the strips are replaced with rigid plastic hook portions; and the ends of the hook portions are fixed to the base body. As shown in FIG. 15, a first fixing portion 13' may include a circular base body 131', one surface of which is fixed on an inner surface of the bag body, and the other surface of which is fixed with a strip 132'. Both ends of the strip 132' are connected with the base body 131' so that a perforation is formed between the strip 132' and the base body 131'. A hook 134 is hooked to the strip 132'.

The bag body is a single layer in the above embodiments. It can be understood that the bag body may be double-layer or multi-layer in other embodiments.

Some or all of the reinforcing strips may be replaced with lines/ropes having a narrower width in other embodiments, and may also be formed into other structures as long as they play roles of limiting the maximum size of the bag body after inflation and preventing the light string system from being excessively pulled.

The fixing manner of the light string system in the bag body should not be limited to the above specific embodiments as long as it is fixed in the bag body and is in the preset shape after the bag body is inflated.

The reinforcing strips or lines may also be omitted, and the light string system is directly fixed between the second fixing portions and the first fixing portions in other embodiments.

The intermediate fixing portion may also be omitted, and various portions of the light string system are connected to each other to limit the shape in the bag body in other embodiments.

Hard hook portions instead of the perforations may be formed in the second fixing portions in other embodiments.

The hooks at both ends of the reinforcing strips or lines may be omitted, and the reinforcing strips or lines are directly fixed to the first fixing portions and the second fixing portions in other embodiments.

The light string system includes a central connecting portion and a plurality of light strips extending from the central connecting portion; each of the light strips is fixed to one reinforcing line or strip; and the central connecting portion is connected with the external controller by a power line and/or a control line in other embodiments.

To sum up, several first fixing portions are arranged on the inner wall of the bag body of the inflatable decorative system, the light string is fixed among the plurality of fixing portions, so that the light string is unfolded into the preset shape after the bag body is inflated. The light string may be directly hung among the plurality of fixing portions, and may also be fixed among the plurality of fixing portions by a reinforcing strip or reinforcing line. After the bag body is inflated, the light string is unfolded to form the preset shape, such as, but not limited to a fireworks display shape irradiating from the middle to the periphery, a Christmas tree shape, a shape including a plurality of stars and moons, etc.; and the shape is variable and stable.

In addition, terms "first" and "second" are only descriptive and are not to be construed as indicating or implying of a relative importance or implicitly indicating of the number of indicated technical features. Thus, the features defined with "first" and "second" may explicitly indicate or implicitly include one or more of the features. "A plurality of" means two or more in the description of the present invention, unless specifically defined otherwise.

The terms "mount", "link", "connect", "fix" and the like in the present invention should be understood broadly, unless explicitly stated and defined otherwise. For example, the "connect" may be fixed connection, detachable connection or integration, may also be mechanical connection or electrical connection, and may be direct connection, indirection connection through an intermediate medium, internal communication of two elements or interaction of two elements. For those ordinary skilled in the art, the specific meanings of the above terms in the present invention can be understood according to specific conditions.

The present invention is described in combination with the above specific embodiments, but it is apparent that those skilled in the art can make many replacements, modifications and changes according to the above contents. Therefore, all the replacements, improvements and changes are included within the spirit and scope of appended claims.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. An inflatable decorative system, comprising:

an inflatable hollow bag body defining a line hole and comprising an inflation port;

a plurality of first fixing portions arranged on an inner surface of the bag body, each first fixing portion having a perforation or a hook portion;

a light string system;

at least one intermediate fixing portion; and a plurality of strips or lines;

wherein at least an end portion of the light string system extends out of the bag body through the line hole, and the remaining portions of the light string system are arranged inside the bag body and fixed among the plurality of first fixing portions so that the light string system is unfolded into a preset shape in the bag body after the bag body is inflated;

wherein the plurality of strips or lines are connected between the at least one intermediate fixing portion and the plurality of first fixing portions, or are simultaneously connected among the plurality of first fixing portions, and a plurality of intermediate fixing portions when the inflatable decorative system is provided with the plurality of intermediate fixing portions; and the plurality of strips or lines are unfolded into a second preset shape after the bag body is inflated and can limit a maximum size of the bag body.

2. The inflatable decorative system according to claim 1, wherein a plurality of second fixing portions are formed on the at least one intermediate fixing portions; and each second fixing portion has a perforation or a hook portion.

3. The inflatable decorative system according to claim 2, wherein both ends of the plurality of strips or lines are provided with hooks, and are connected with the first fixing portions and the second fixing portions by the hooks.

4. The inflatable decorative system according to claim 3, wherein the intermediate fixing portion has a structure chosen from one of the following structures: a, the intermediate fixing portion comprising a sphere, and the plurality of second fixing portions being formed on an outer surface of the sphere; b, the intermediate fixing portion comprising a sphere provided with a plurality of circular rings on the outer surface, and the plurality of second fixing portions being arranged on the circular rings; c, the intermediate fixing portion comprising a plurality of circular rings connected together, and the plurality of second fixing portions being arranged on the circular rings; and d, a plurality of hollow portions being formed on the intermediate fixing portion, and ribs among the plurality of hollow portions being used as the plurality of second fixing portions for fixing the strips or lines.

5. The inflatable decorative system according to claim 4, wherein when one intermediate fixing portion is provided, each strip or line is connected between one first fixing portion and one second fixing portion, and the light string system comprises one or two or more parallel light strings/light strips; the light strings/light strips extend to the intermediate fixing portion along one strip or line after stretching in the line hole, fold back to the intermediate fixing portion after extending to a position close to the first fixing portion along the other strip or line, extend along all the strips or lines in this way, finally return to the line hole along the first strip or line and extend out of the line hole, to form a state of fireworks explosion.

6. The inflatable decorative system according to claim 5, wherein a transparent hose is sleeved on each strip or line to protect a portion of the light string system fixed on the strip or line in the hose.

7. The inflatable decorative system according to claim 4, wherein when one intermediate fixing portion is provided, each strip or line is connected between one first fixing portion and one second fixing portion, and the light string system comprises one or two or more parallel light strings/light strips; the light strings/light strips extend to the intermediate fixing portion along one strip or line after stretching in the line hole, and then extend to positions close to the first fixing portions along other strips or lines, to form a state of fireworks explosion.

8. An inflatable decorative system, comprising:

an inflatable hollow bag body defining a line hole and comprising an inflation port;

a plurality of first fixing portions arranged on an inner surface of the bag body, each first fixing portion having a perforation or a hook portion;

a light string system; and a reinforcing portion for limiting the maximum size when the bag body is inflated, wherein at least an end portion of the light string system extends out of the bag body through the line hole, and the remaining portions of the light string system are arranged inside the bag body and fixed among the plurality of first fixing portions so that the light string system is unfolded into a preset shape in the bag body after the bag body is inflated;

wherein the reinforcing portion comprises at least one line or strip or a composition of the line and the strip; and the reinforcing portion is connected among the plurality of first fixing portions and is suspended inside the hollow bag body when the bag body is inflated.

9. The inflatable decorative system according to claim 8, wherein the at least one line or strip or the composition of the line and the strip of the reinforcing portion forms one intermediate fixing portion and a plurality of strips or lines extending from the intermediate fixing portion; and tail ends of the plurality of strips or lines are respectively connected with the plurality of first fixing portions.

* * * * *